US008957822B2

(12) United States Patent
Mendenhall

(10) Patent No.: US 8,957,822 B2
(45) Date of Patent: Feb. 17, 2015

(54) OPERATION OF AN ANTENNA ON A SECOND, HIGHER FREQUENCY

(75) Inventor: Geoffrey N. Mendenhall, Cincinnati, OH (US)

(73) Assignee: ImagineCommunications Corp., Englewood, CO (US)

( * ) Notice: Subject to any disclaimer, the term of this patent is extended or adjusted under 35 U.S.C. 154(b) by 202 days.

(21) Appl. No.: 13/613,455

(22) Filed: Sep. 13, 2012

(65) Prior Publication Data

US 2014/0071012 A1 Mar. 13, 2014

(51) Int. Cl.
*H01Q 9/04* (2006.01)

(52) U.S. Cl.
USPC ..... 343/791

(58) Field of Classification Search
USPC ..... 343/791, 700 MS, 725, 749, 893
See application file for complete search history.

(56) References Cited

U.S. PATENT DOCUMENTS

| | | | | |
|---|---|---|---|---|
| 2,996,718 | A | 8/1961 | Foley | |
| 3,550,145 | A | 12/1970 | Tai | |
| 4,259,672 | A | 3/1981 | Newcomb | |
| 4,630,060 | A | 12/1986 | Newcomb | |
| 4,635,068 | A * | 1/1987 | Wheeler et al. | 343/749 |
| 6,266,026 | B1 | 7/2001 | Stengel, Jr. | |
| 7,136,026 | B2 * | 11/2006 | Lee | 343/791 |
| 7,598,917 | B2 * | 10/2009 | Chen | 343/725 |
| 7,999,757 | B2 * | 8/2011 | Du | 343/893 |
| 2005/0057425 | A1 | 3/2005 | Mendenhall et al. | |
| 2005/0134511 | A1 * | 6/2005 | Haunberger et al. | 343/725 |
| 2005/0212713 | A1 | 9/2005 | Dai et al. | |
| 2007/0085743 | A1 * | 4/2007 | Eberhardt et al. | 343/700 MS |
| 2007/0247382 | A1 | 10/2007 | Wan | |
| 2011/0291909 | A1 | 12/2011 | Heckler et al. | |

FOREIGN PATENT DOCUMENTS

FR 52 479 E 4/1945

OTHER PUBLICATIONS

Cushcraft Corporation, "Assembly and Installation Instructions", (date Unknown) pp. 1-14.
Int'l Search Report—5 pgs., Apr. 18, 2013, Harris Corporation.
Written Opinion of the Int'l Searching Authority—7 pgs., Apr. 18, 2013, Harris Corporation.

* cited by examiner

*Primary Examiner* — Huedung Mancuso
(74) *Attorney, Agent, or Firm* — Tarolli, Sundheim, Covell & Tummino LLP

(57) ABSTRACT

Systems and methods are provided for operating an existing antenna at a second, higher frequency. To this end, an antenna system includes an antenna feed and a first antenna assembly electrically connected to the antenna feed at a first end. The first antenna assembly has a first electrical length for a first frequency band and includes a substantially linear segment. A second antenna element is connected to the first antenna assembly and extends away from the first end of the first antenna assembly in a direction substantially parallel to the substantially linear segment. The second antenna element has an electrical length of one-quarter of a wavelength associated with a second frequency.

16 Claims, 4 Drawing Sheets

OPERATION OF AN ANTENNA ON A SECOND, HIGHER FREQUENCY

TECHNICAL FIELD

The present invention relates to radio frequency (RF) communication systems and is particularly directed to antenna systems and a method for operating an antenna system on a second, higher frequency.

BACKGROUND OF THE INVENTION

An antenna is an electrical device that converts electric currents into radio waves, and vice versa. It is usually used with a radio transmitter or radio receiver. In transmission, a radio transmitter applies an oscillating radio frequency electric current to the antenna's terminals, and the antenna radiates the energy from the current as electromagnetic waves. In reception, an antenna intercepts some of the power of an electromagnetic wave in order to produce a current in the antenna conductor(s) which results in tiny voltage at its terminals, which is applied to a receiver to be amplified. An antenna is a reciprocal device and can be used for both transmitting and receiving. Antennas are used in systems such as radio broadcasting, broadcast television, two-way radio, communications receivers, radar, cell phones, and satellite communications, as well as other devices such as garage door openers, wireless microphones, Bluetooth enabled devices, wireless computer networks, baby monitors, and RFID tags on merchandise.

Typically an antenna consists of an arrangement of metallic conductors ("elements"), electrically connected to the receiver or transmitter. An oscillating current of electrons forced through the antenna by a transmitter will create an oscillating magnetic field around the antenna elements, while the charge of the electrons also creates an oscillating electric field along the elements. These time-varying fields radiate away from the antenna into space as a moving electromagnetic field wave. Conversely, during reception, the oscillating electric and magnetic fields of an incoming radio wave exert force on the electrons in the antenna elements, causing them to move back and forth, creating oscillating currents in the antenna.

SUMMARY OF THE INVENTION

In accordance with an aspect of the present invention, an antenna system includes an antenna feed and a first antenna assembly electrically connected to the antenna feed at a first end. The first antenna assembly has a first electrical length for a first frequency band and includes a substantially linear segment. A second antenna element is connected to the first antenna assembly and extends away from the first end of the first antenna assembly in a direction substantially parallel to the substantially linear segment. The second antenna element has an electrical length of one-quarter of a wavelength associated with a second frequency.

In accordance with another aspect of the present invention, a method is provided for modifying a first antenna assembly, having a first operating frequency, to be made suitable for a second, higher, operating frequency. A second antenna element is electrically connected to the first antenna assembly and extends away from a feed point of the first antenna assembly in a direction substantially parallel to the first antenna assembly. The second antenna element has an electrical length substantially equal to a quarter of a wavelength associated with the second operating frequency. A first feed is provided to the antenna at the first operating frequency through a first impedance source. A second feed is provided to the antenna at the second operating frequency through a second impedance source.

In accordance with yet another aspect of the present invention, a method is provided for modifying a vertical antenna tower, having a first operating frequency, to be made suitable for a second, higher, operating frequency. A plurality of second antenna elements are electrically connected to the vertical antenna tower at respective first ends. Each second antenna element extends parallel with the tower and terminates at open second ends at a distance above the point of connection substantially equal to a quarter of a wavelength associated with the second frequency. First and second feeds are simultaneously provided to the antenna at the first operating frequency and the second operating frequency, respectively.

BRIEF DESCRIPTION OF THE DRAWINGS

The foregoing and other features of the present invention will become apparent to those skilled in the art to which the present invention relates upon consideration of the following description of the invention with reference to the accompanying drawings, wherein.

DESCRIPTION OF THE PREFERRED EMBODIMENT

Figure 1:
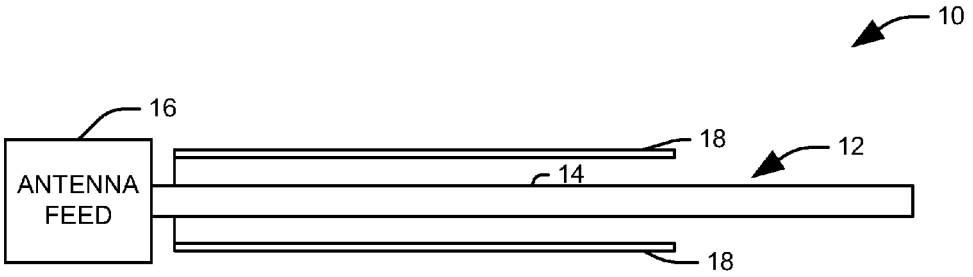
FIG. 1 is a functional diagram of an antenna system in accordance with an aspect of the present invention.

FIG. 1 is a functional diagram of an antenna system 10 in accordance with an aspect of the present invention. The antenna system 10 includes an antenna assembly 12, having a first electrical length for a first frequency band. As used herein, the phrase "electrical length" is the length of an antenna expressed as the number of wavelengths of the signal propagating in the medium at an associated frequency. The first antenna assembly includes a substantially linear segment 14. It will be appreciated that by the phrase "substantially linear", it is intended that the first antenna assembly 12 contains a linear extent of significant size, but it will be appreciated that a substantial portion of the electrical length of the first antenna assembly 12 can be provided by portions of the first antenna assembly other than the linear segment, including one or more loading elements (not shown). The first antenna assembly 12 can be fed by an antenna feed 16 to broadcast a signal within the first frequency band.

In accordance with an aspect of the present invention, a second antenna assembly 18 can be electrically connected to the first antenna assembly 12 at a first end and extend away from the antenna feed 16 in a direction substantially parallel to the linear segment 14. The second antenna assembly 18 is configured to have an electrical length of one-quarter wavelength at a second frequency. It will be appreciated that, while the second antenna assembly 18 is illustrated as two elements radially spaced from the linear segment 14, the placement of the second antenna assembly will vary with the implementation, so long as electrical isolation is maintained away from the point at which the two structures are electrically connected and the second antenna assembly is arranged symmetrically around a rotational axis of symmetry of the substantially linear segment 14. For example, in one implementation, the second antenna assembly is a cylindrical structure substantially enclosing at least a portion of the first antenna assembly 12. In the illustrated implementation, the conductive elements comprising the second antenna assembly 18 arranged evenly around a circumference of the substantially linear segment 14 and connected to the first antenna assembly at respective first ends at a point closest to the antenna feed 16.

In the illustrated system 10, for signals at and around the second frequency, the second antenna assembly 18 effectively decouples any portion of the first antenna assembly 12 past the open end of the second antenna assembly. Accordingly, for these signals, the electrical length of the antenna is defined by the second antenna assembly 18 and any portion of the first antenna assembly between the antenna feed 16 and the point at which the second antenna assembly 18 is connected to the first antenna assembly 12. It will be appreciated that the electrical length of the antenna at the second frequency can be adjusted by shifting the position of connection of the second antenna 18 assembly to increase or decrease the distance of the point of connection with the first antenna assembly 12 from the antenna feed 16. This has the effect of allow adjustment of the impedance of the second antenna assembly 18, as seen at the feed 16, and allows an elevation radiation pattern of the antenna at the second frequency to be altered.

For signals in the first frequency band, the second antenna assembly 18 has a minimal effect on the antenna system 10, allowing for simultaneous dual-band operation with the antenna system. It will be appreciated that, given sufficient disparity between the first frequency, the illustrated system 10 could become unsuitable for dual band use. While the disparity tolerated by the system will vary with the specific application, the technique is generally practical at least for dual band applications in which the second frequency is between two to ten times the first frequency. To allow for dual band operation, the antenna feed 16 can include a first antenna feed, providing a signal at the first frequency, and a second antenna feed, providing a signal at the second frequency.

Figure 2:
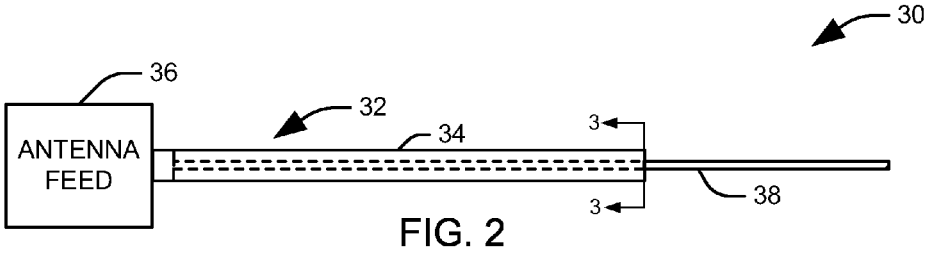
FIG. 2 is a functional diagram of an alternative implementation of an antenna system in accordance with an aspect of the present invention.

FIG. 2 is a functional diagram of an alternative implementation of an antenna system 30 in accordance with an aspect of the present invention. Like the system illustrated in FIG. 1, the antenna system 30 includes a first antenna assembly 32, having a substantially linear portion 34, attached to an antenna feed 36. In the illustrated implementation, however, a second antenna assembly 38 is positioned inside of the linear segment 34 in a coaxial arrangement, and extends beyond the first antenna assembly 32. The second antenna assembly 38 is electrically connected to the first antenna assembly 32 at a first end and extends away from the antenna feed 36, such that the first end is closer to the antenna feed 36 than a second, end.

In this arrangement, signals at and around the first frequency, the antenna system 30 functions as an antenna with a length from a first end of the first antenna assembly 32, at which the first antenna assembly connects to the antenna feed 36, to the second end of the second antenna assembly 38, which extends beyond a second end of the first antenna assembly. Accordingly, the electrical length of the antenna system is a function of the length and position of each of the first antenna assembly 32 and the second antenna assembly 38. For signals at and around the second frequency, the portion of the second antenna assembly 38 extending beyond the first antenna assembly 32 is effectively decoupled. The electrical length of the antenna at these frequencies is effectively defined by the length of the first antenna assembly 32. The resulting antenna system 30 provides dual-band operation at the first and second frequencies.

Figure 3:
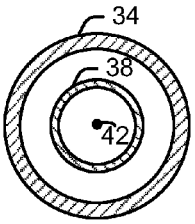
FIG. 3 is a cross-sectional view of the antenna system of FIG. 2 along line 3-3.

FIG. 3 illustrates a cross-sectional view of the antenna system of FIG. 2 taken along line 3-3, representing an end of the substantially linear portion 34 that is farthest from the antenna feed 36. It will be appreciated from this diagram that the substantially linear portion 34 and the second antenna assembly 38 are not connected at the end farthest from the antenna feed 36, referred to hereinafter as the "open end" of the antenna. Each of the substantially linear portion 34 and the second antenna assembly 38 are arranged symmetrically around an axis of rotational symmetry 42 of the substantially linear portion.

Figure 4:
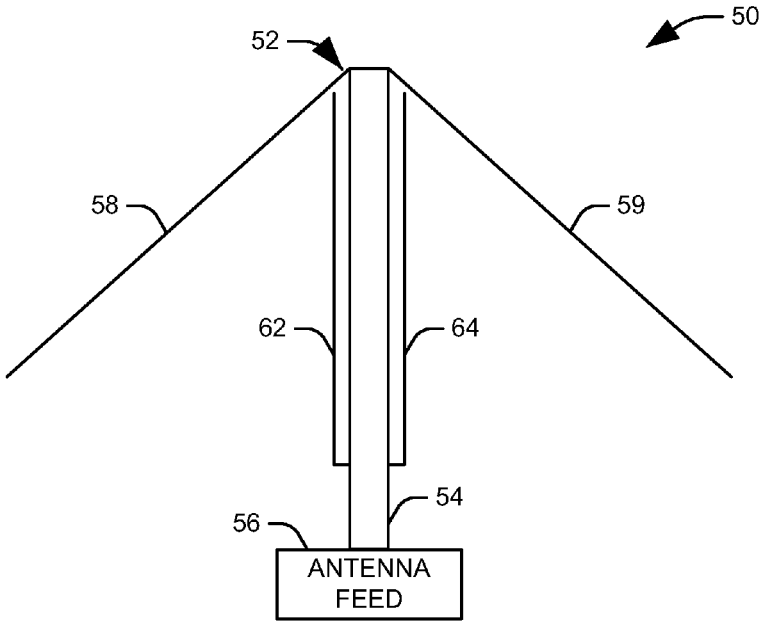
FIG. 4 is a functional diagram of a modified antenna system in accordance with an aspect of the present invention.

FIG. 4 provides a functional diagram of a modified antenna system 50 in accordance with an aspect of the present invention. In accordance with an aspect of the present invention, a main antenna structure 52 is configured to have a desired electrical length within a first frequency band. In the illustrated implementation, the main antenna structure 52 includes a vertical tower 54 with a feed 56 at the base of the tower and a plurality of top-loaded guy wires 58 and 59 extending from an uppermost portion of the vertical tower. In one implementation, the feed 56 can include two separate impedance transformation networks, with appropriate tuned circuits to provide isolation between them, through which first and second feeds associated the first and second frequency bands are provided.

In one example, the vertical tower 54 is approximately six hundred twenty-eight feet tall and six feet in diameter, with twenty-four six-hundred foot guy wires extending from the top of the tower at an angle of approximately forty-three degrees and terminated in insulators. In this implementation, the antenna system 50 can operate in a frequency band around one hundred kilohertz.

In accordance with an aspect of the present invention, the antenna system 50 has been modified with a second antenna assembly comprising a plurality of conductive elements 62 and 64, substantially equally spaced around the circumference of the tower 54, to allow the antenna system to operate in a second frequency band. Each of the conductive elements 62 and 64 is electrically connected to the tower 54 and extends upwardly at a determined spacing from the tower to terminate in open ends. Each conductive element 62 and 64 is configured to have an electrical length substantially equal to one-quarter of a wavelength associated with a second frequency. In the illustrated implementation, the second frequency is five hundred kilohertz, and four conductive elements are spaced from the tower by about ten feet and extend from a point one hundred fifteen feet from the base of the tower to a point approximately six hundred and seven feet above the base of the tower.

The modified antenna system 50 can operate efficiently in frequency bands around both the first and second frequencies. For example, for signals at and around the first frequency, the conductive elements 62 and 64 appear as small inductors, and do not substantially affect the normal operation of the tower. For a signal near the second frequency, however, the conductive elements 62 and 64 produce an open circuit at their ends, effectively decoupling the portion of the main antenna structure 52 beyond the open ends of the conductive antenna elements 62 and 64, including the top loaded guy wires 58 and 59, from the antenna feed 56. As a result, the antenna has a first electrical length around the first frequency and a second electrical length around the second frequency.

Figure 5:
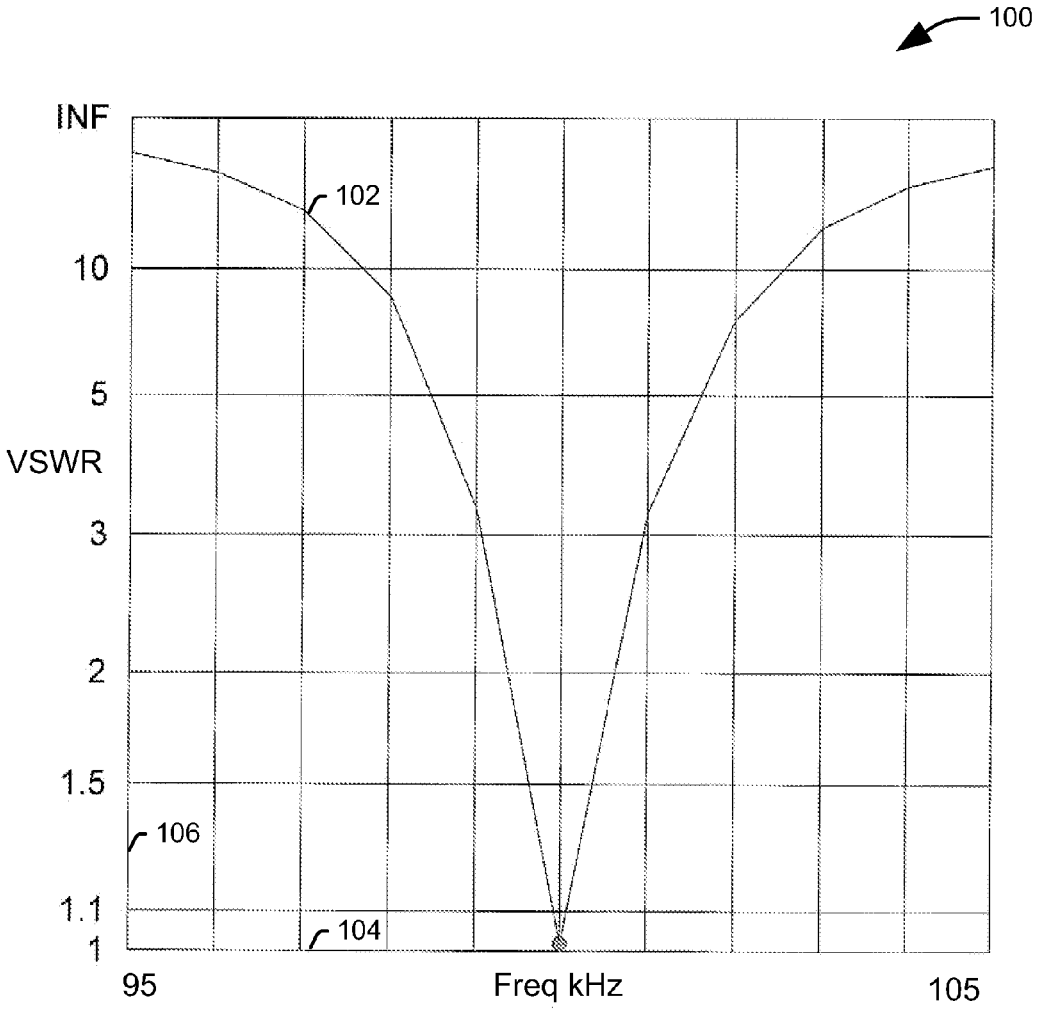
FIG. 5 is a chart of the Voltage Standing Wave Ratio frequency response centered around a frequency of 100 kHz of the modified antenna system of FIG. 4 when the antenna system is series fed through an appropriate impedance matching network.

FIG. 5 is a chart 100 of a Voltage Standing Wave Ratio (VSWR) frequency response 102 of the modified antenna system of FIG. 4 when the antenna system is series fed through an appropriate impedance matching network. In the illustrated chart, the horizontal axis 104 represents an operating frequency, in megahertz, and the vertical axis 106 represents a voltage standing wave ratio (VSWR) of the antenna. It will be appreciated from the chart 100 that the antenna provides efficient operation at and immediately around one hundred kilohertz.

Figure 6:
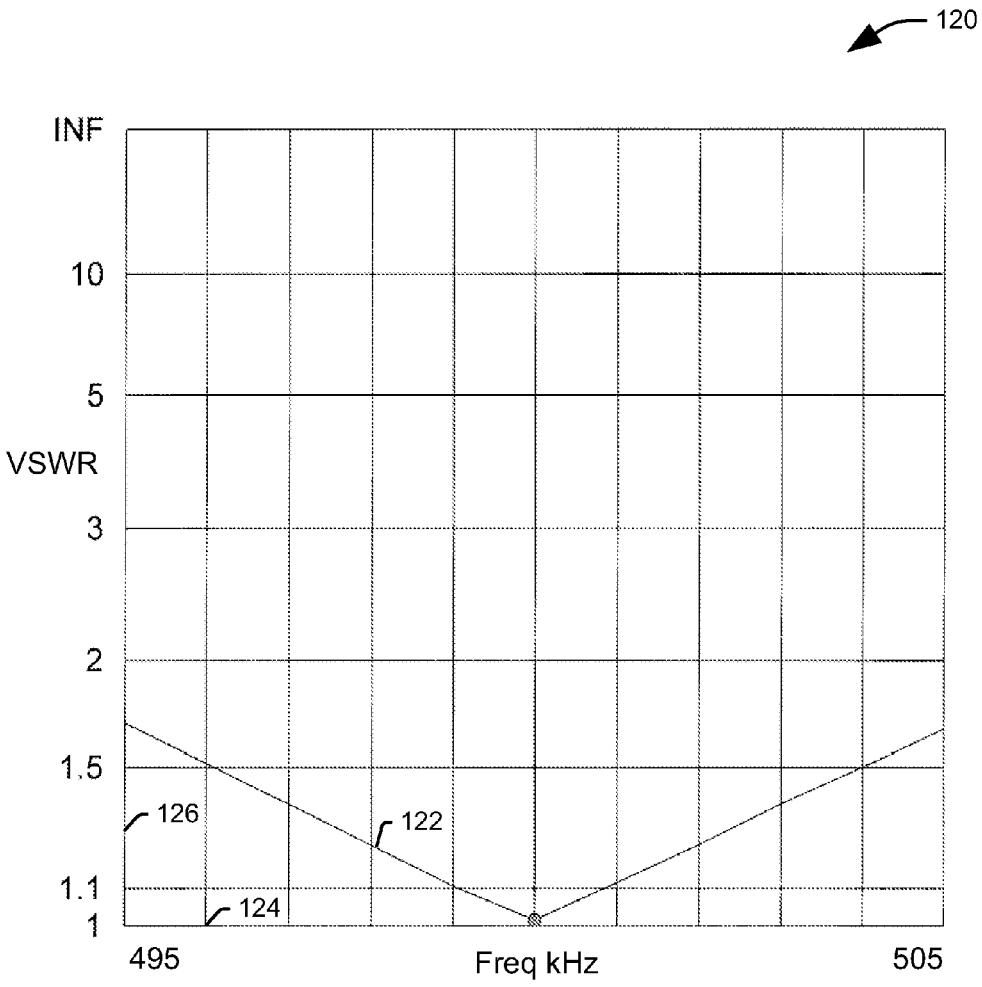
FIG. 6 is a chart of the Voltage Standing Wave Ratio frequency response centered on a frequency of 500 kHz of the modified antenna system of FIG. 4 when the antenna system is series fed through an appropriate impedance matching network.

FIG. 6 is a chart 120 of a Voltage Standing Wave Ratio (VSWR) frequency response 122 of the modified antenna system of FIG. 4 when the antenna system is series fed through an appropriate impedance matching network. As in FIG. 5, the horizontal axis 124 represents frequency, in megahertz, and the vertical axis 126 represents a standing wave ratio (VSWR) of the antenna. As can be seen from the chart 120, the antenna provides efficient operation at and immediately around five hundred kilohertz. It will be appreciated, of course, that both feeds can be simultaneously applied to the antenna system from a common feed point, allowing for dual-band operation at both one hundred kilohertz and five hundred kilohertz.

Figure 7:
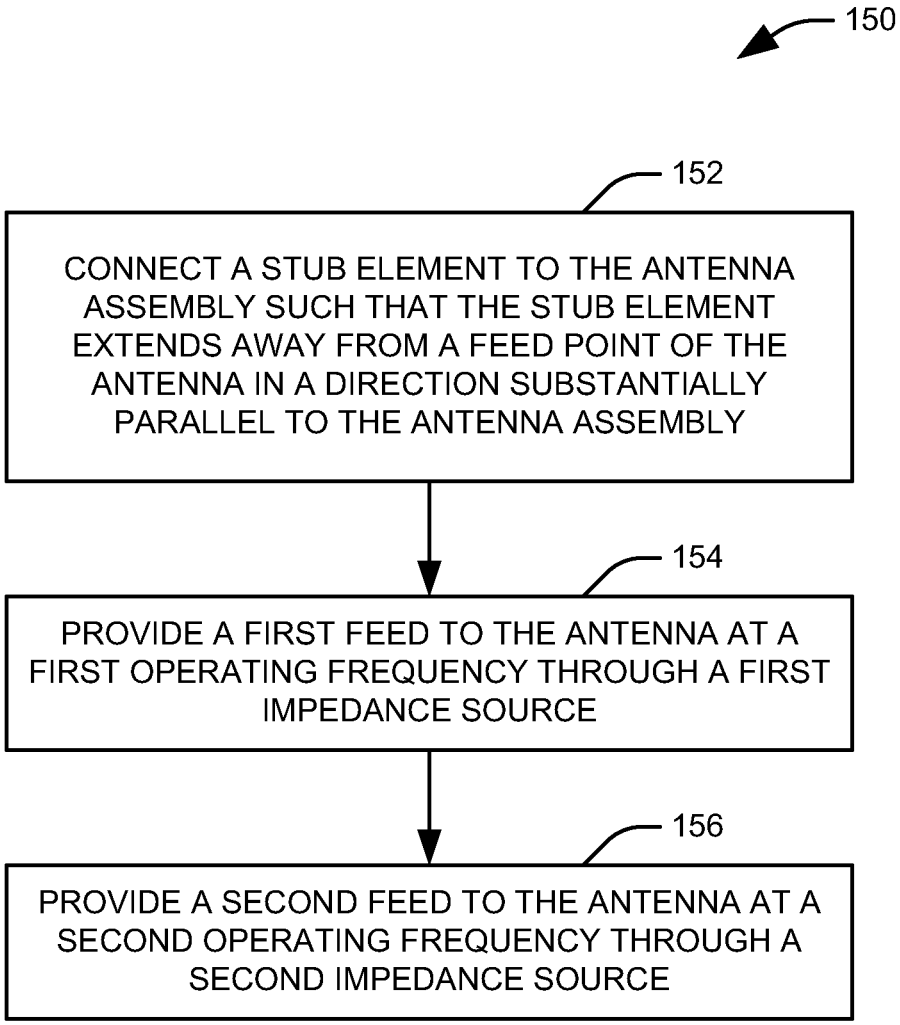
FIG. 7 illustrates a method for modifying a first antenna assembly, having a first operating frequency, to be made suitable for a second, higher, operating frequency in accordance with an aspect of the present invention.

FIG. 7 illustrates a method 150 for modifying a first antenna assembly, having a first operating frequency, to be made suitable for a second, higher, operating frequency in accordance with an aspect of the present invention. Depending on the implementation, the second operating frequency can be between two and ten times the first operating frequency. For example, in one implementation, in which the first antenna assembly is a vertical antenna tower, a first operating frequency can be around one hundred kilohertz and the second operating frequency can be around five hundred kilohertz, such that the second operating frequency is five times the first operating frequency.

At 152, a second antenna assembly is electrically connected to the antenna assembly such that the open (unconnected) end of the second antenna assembly extends away from the closed end and feed point of the first antenna assembly in a direction substantially parallel to the first antenna assembly. The second antenna assembly has an electrical length substantially equal to a quarter of a wavelength associated with the second operating frequency.

In one implementation, the second antenna assembly can include a plurality of conductive elements radially spaced from the first antenna assembly and located at substantially even intervals around a circumference of the first antenna assembly. In another implementation, the second antenna assembly can be a hollow, cylindrical element positioned as to substantially enclose at least a portion of the first antenna assembly.

At 154, a first feed is provided to the antenna at the first operating frequency through a first impedance source. In one example, the first impedance source, associated with the lower frequency signal, is primarily inductive. At 156, a second feed is provided to the antenna at the second operating frequency through a second impedance source. In one example, the second impedance source, associated with the higher frequency signal, is primarily capacitive. In one implementation, the first feed and the second feed are provided simultaneously at a common feed point, such that 154 and 156 occur in parallel.

From the above description of the invention, those skilled in the art will perceive improvements, changes, and modifications. Such improvements, changes, and modifications within the skill of the art are intended to be covered by the appended claims.

Having described the invention we claim:

1. An antenna system comprising:

an antenna feed;

a first antenna assembly electrically connected to the antenna feed at a first end, the first antenna assembly having a first electrical length for a first frequency band and comprising a substantially linear segment, the substantially linear segment having a rotational axis of symmetry; and a second antenna assembly, having an electrical length of one-quarter of a wavelength associated with a second frequency, arranged symmetrically around the rotational axis of symmetry of the substantially linear segment and connected to the first antenna assembly, the second antenna assembly extending from a point of connection with the first antenna assembly in a direction away from the first end of the first antenna assembly and substantially parallel to the substantially linear segment, the point of connection with the first antenna assembly being remote from the antenna feed.

2. The antenna system of claim 1, the second antenna element being electrically connected to the substantially linear segment.

3. The antenna system of claim 2, wherein the substantially linear segment comprises a cylindrical wall and the second antenna element is at least partially located within the substantially linear segment in a coaxial arrangement.

4. The antenna system of claim 2, wherein the second antenna element is radially spaced from the substantially linear segment.

5. The antenna system of claim 1, wherein the second antenna assembly comprises a plurality of conductive elements radially spaced from the substantially linear segment and located at substantially even intervals around a circumference of the substantially linear segment.

6. The antenna system of claim 1, wherein the first antenna assembly includes at least one loading element on a second end, the second antenna assembly being configured to decouple the loading element from the antenna feed when the antenna system is operating at the second frequency.

7. The antenna system of claim 1, wherein the antenna feed comprises a first antenna feed, providing a signal at the first frequency, and a second antenna feed, providing a signal at the second frequency.

8. The antenna system of claim 1, where the second antenna element is a cylindrical structure substantially enclosing at least a portion of the first antenna assembly.

9. A method for modifying a first antenna assembly, having a first operating frequency, to be made suitable for a second, higher, operating frequency, the method comprising:

electrically connecting a second antenna assembly to the first antenna assembly, the second antenna assembly extending away from a feed point of the first antenna assembly in a direction substantially parallel to the first antenna assembly and having an electrical length substantially equal to a quarter of a wavelength associated with the second operating frequency, wherein the second antenna assembly comprises a plurality of conductive elements radially spaced from the first antenna assembly and located at substantially even intervals around a circumference of the first antenna assembly with each conductive element electrically connected to the first antenna assembly at a first end the conductive element that is closest to the feed point and open on a second end; and providing a first feed to the antenna at the first operating frequency through a first impedance source; and providing a second feed to the antenna at the second operating frequency through a second impedance source.

10. The method of claim 9, wherein the second operating frequency is between two and ten times the first operating frequency.

11. The method of claim 9, wherein electrically connecting the second antenna assembly to the first antenna assembly comprises connecting a hollow, cylindrical element to the first antenna assembly, such that the second antenna assembly substantially encloses at least a portion of the first antenna assembly.

12. The method of claim 9, wherein the first feed and the second feed are provided simultaneously through respective first and second impedance transformation networks to a common feed point, the first and second impedance transformation networks operating at the first and second operating frequencies, respectively.

13. A method for modifying a vertical antenna tower, having a first operating frequency, to be made suitable for a second, higher, operating frequency, the method comprising:

electrically connecting a plurality of antenna elements to the vertical antenna tower at respective first ends, each antenna element extending parallel with the tower and terminating at open second ends at a distance above the point of connection substantially equal to a quarter of a wavelength associated with the second frequency, the plurality of antenna elements being positioned such that at least one loading element associated with the vertical tower is isolated from the antenna feed when the antenna system is operating at the second frequency; and simultaneously providing a first and second feeds to the antenna at the first operating frequency and the second operating frequency, respectively.

14. The method of claim 13, wherein simultaneously providing the first and second feeds to the antenna comprises simultaneously providing the first and second feeds to a common feed point through respective first and second impedance transformation networks, the first and second impedance transformation networks operating at the first and second operating frequencies respectively.

15. The method of claim 13, wherein electrically connecting the plurality of antenna elements to the vertical antenna tower comprises connecting the plurality of antenna elements to the vertical tower such that they are located at substantially even intervals around a circumference of the vertical antenna tower and arranged symmetrically around the vertical antenna tower.

16. The method of claim 13, wherein the second operating frequency is five times the first operating frequency.

* * * * *